US005555995A

United States Patent [19]

Galer

[11] Patent Number: 5,555,995

[45] Date of Patent: Sep. 17, 1996

[54] SQUARE CONTAINER FOR HAZARDOUS POWDERED MATERIALS

[76] Inventor: Herbert W. Galer, 303 Channel Run, Washington, N.C. 27889

[21] Appl. No.: 414,934

[22] Filed: Mar. 31, 1995

[51] Int. Cl.[6] ..... B65D 43/12

[52] U.S. Cl. ..... 220/346; 220/315; 220/324

[58] Field of Search ..... 220/336, 345, 220/346, 315, 212.5, 763, 252, 254, 351, 324; 215/322, 235; 229/125.12, 125.125

[56] References Cited

U.S. PATENT DOCUMENTS

| | | | |
|---|---|---|---|
| 1,962,860 | 6/1934 | Duell et al. | 220/351 X |
| 3,942,630 | 3/1976 | Phillips | 220/346 X |
| 4,113,098 | 9/1978 | Howard | 220/351 X |
| 4,917,254 | 4/1990 | Ciriacks | 220/351 X |
| 5,105,335 | 4/1992 | Honda | 220/763 X |
| 5,368,162 | 11/1994 | Holmgren | 220/315 X |
| 5,405,034 | 11/1995 | Mittel, Jr. | 215/322 |
| 5,419,450 | 5/1995 | Guglielmelli et al. | 220/212.5 X |

FOREIGN PATENT DOCUMENTS

| | | | |
|---|---|---|---|
| 2645124 | 10/1990 | France | 220/346 |
| 2447903 | 4/1976 | Germany | 220/346 |

*Primary Examiner*—Gary E. Elkins
*Assistant Examiner*—Nathan Newhouse
*Attorney, Agent, or Firm*—William L. Krayer

[57] ABSTRACT

A child-protected thermoplastic container having a generally square shape including a closure having horizontal sealing surfaces complimentary to sealing surfaces on the top of parallel container sides, and including tapered guide surfaces on the parallel sides to guide the closure from back to front for closing while forcing a tight seal on the sealing surfaces. The front of the closure is provided with a handle which snaps closed to effectuate a tight seal on the front, which must be opened before the closure will slide back to open the container.

3 Claims, 5 Drawing Sheets

SQUARE CONTAINER FOR HAZARDOUS POWDERED MATERIALS

TECHNICAL FIELD

This invention relates to thermoplastic containers, particularly to thermoplastic containers useful for shipping and retaining hazardous powdered materials likely to be stored where small children may be inclined to try to open the containers; the containers of this invention are particularly useful for chlorine-containing swimming pool chemicals, and typically will hold from about one to about ten gallons of powdered material.

BACKGROUND OF THE INVENTION

Containers for hazardous powdered materials have, for a number of years, been made from thermoplastic compositions. Thermoplastic containers have the advantages that they can be made relatively inexpensively by injection molding, the construction materials are not subject to serious attack by highly corrosive contents such as sodium hypochlorite, and they can be designed to have integral closure mechanisms and the like more readily than when using metal or glass.

Such containers have very frequently been designed in the traditional cylindrical shape, however, which is very wasteful of space during shipment and storage. Those containers which are designed with a square, instead of circular, shape tend not to have a lid or closure which provides access to the entire area of the top of the container. Typically, they will have a square top which cannot be removed from the container, having a much smaller circular or other opening or spout built into it. The user can never be sure what he or she has to do to completely empty the container, since he or she cannot see into it, and the opening is seldom at a corner of the square so one can pour the contents out from one orientation.

In the past, it may have been considered expedient to design an opening smaller in area than the top of a square container so that the junction of the top and the sides of the container could be made of one piece or permanently joined, to minimize problems with impact tests such as the United Nations shipping requirements. But if that is so, it is based on an assumption that a seal around the junction of the top and the sides is too difficult to accomplish when using a removable closure.

SUMMARY OF THE INVENTION

The container of my invention combines the advantages of economy of shipping and storage, through its rectangular shape, with a design which will withstand severe drop and impact tests and at the same time is resistant to children, yet convenient for adults because the entire top is open after removal of the closure. It refutes the last mentioned assumption that a seal around the junction of the top and the sides is too difficult to accomplish with a removable closure.

My basic concept is for the closure to open in a manner unusual for a container of its size and purpose, namely by sliding in one direction only. The cover is unlocked from the container by pulling the handle of the lock bar outward to disengage the lock from the front of the container. The lock bar is then rotated out of the way, enabling the cover to be slid backward to open the container. These actions are easy enough for an adult to comprehend, but will frustrate children, both physically and mentally. While the closure is in place, a seal around the entire periphery of the container ensures that no spillage will take place under severe stress, such as during a drop test; the effect of the peripheral seal is enhanced by the fact that the seal at the "front" of the container is effected by an overlap in one direction while the remaining three sides overlap in the other.

My invention therefore comprises a container body having two substantially parallel sides, a front, a back, and a generally open top, and a closure of a complementary shape having two parallel sides; the two parallel sides and the back of the closure are provided with a continuous peripheral lip, or substantially horizontal surface, which mates with a complementary ridge (substantially horizontal surface) on the container. On the front of the closure, a similar complementary lip and ridge is designed to mate in a manner opposite the other three sides—that is, in one case, a lip having a U-shaped profile may mate with an inverted U-shaped profile on the ridge, and in the other case, the orientation of the profiles will be reversed. Sliding the closure from the back towards the front of the pail body causes the overlapping edges of the peripheral complementary lip and ridge to snap into place when the closure reaches its final position on the container; this is brought about by cantilever guides on the parallel sides which force the mating surfaces into a tight seal, as will be explained below. The cantilever guides also ensure that a locking lug at the front end of the guided surface of the closure also snaps into its intended home, an aperture in one of the reinforcing ribs of the pail. The snap fit is achieved by a press fit of the projection into its intended hole. This adds to the force required to open the container and creates an additional barrier to frustrate and thus prevent a small child from opening the container. An additional safety feature of my container is a hinged lock bar built into the closure at its front. The hinged lock bar requires separate attention by anyone intending to open the container; it must be opened before the closure can be removed.

Thus it will be seen that my invention comprises (a) a container body having two substantially parallel container sides, a container front, a container back, and an open top defined by a chime, (b) a closure of a shape generally similar to said open top, including a closure front, a closure back, and two parallel closure sides, said closure back and closure sides having skirts adapted to overlap said chime and having substantially horizontal sealing surfaces, (c) substantially horizontal sealing surfaces on said substantially parallel container sides and container back adapted to mate with and form a tight seal with said complementary substantially horizontal sealing surfaces on said parallel closure sides and closure back when said closure is in a position covering said open top, (d) complementary tapered guide surfaces on said container sides and said closure sides for guiding said closure frontwardly from the back of said container, said tapered guide surfaces adapted to force said closure downwardly to effect said tight seal between said substantially horizontal sealing surfaces on said parallel sides and container back, (e) sealing surfaces on said container front and said closure front such that the sealing surface on said closure front engages beneath the sealing surface on the container front, when said closure is in a position covering said open top, (f) a projecting nub at the front end of said guide surfaces of said closure sides, adapted to be lockably inserted into an aperture in said container body, when said closure is guided into place to cover said open top, and (g)(f) a hinged lock bar on said closure adapted to fixedly and sealably engage a lock bar receiving chime on said front of said container body when said closure is in position covering said open top.

My invention will be described in more detail in the following section, and with reference to the drawings.

DETAILED DESCRIPTION OF THE INVENTION

Figure 5A:
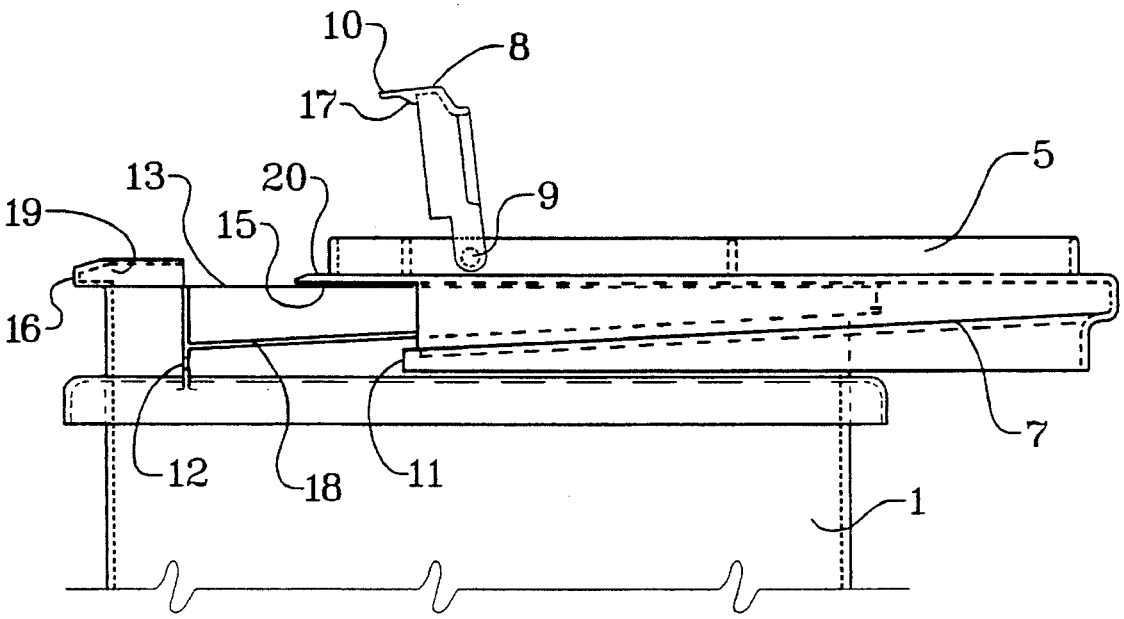
Figure 5B:
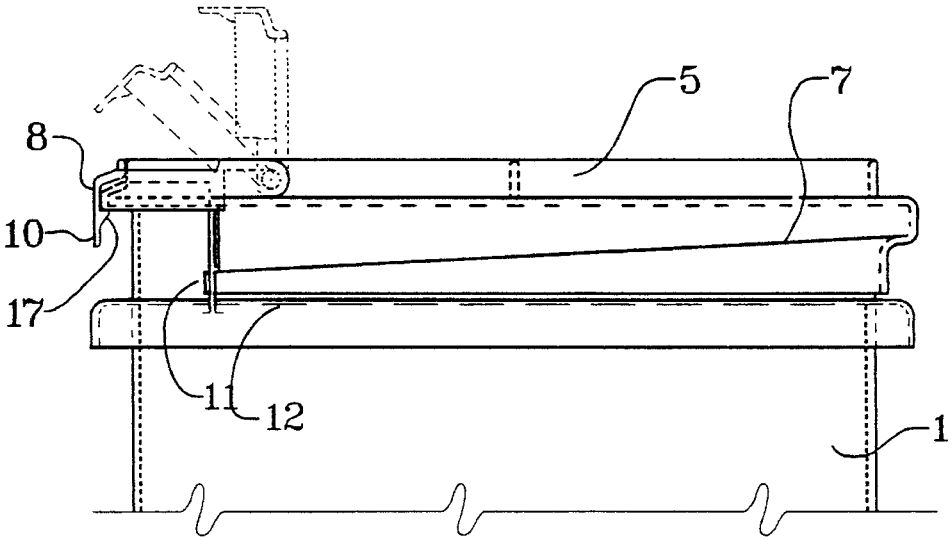

FIGS. 5*a* and 5*b* illustrate the movement of the closure into place on the top of the container.

Figure 1:
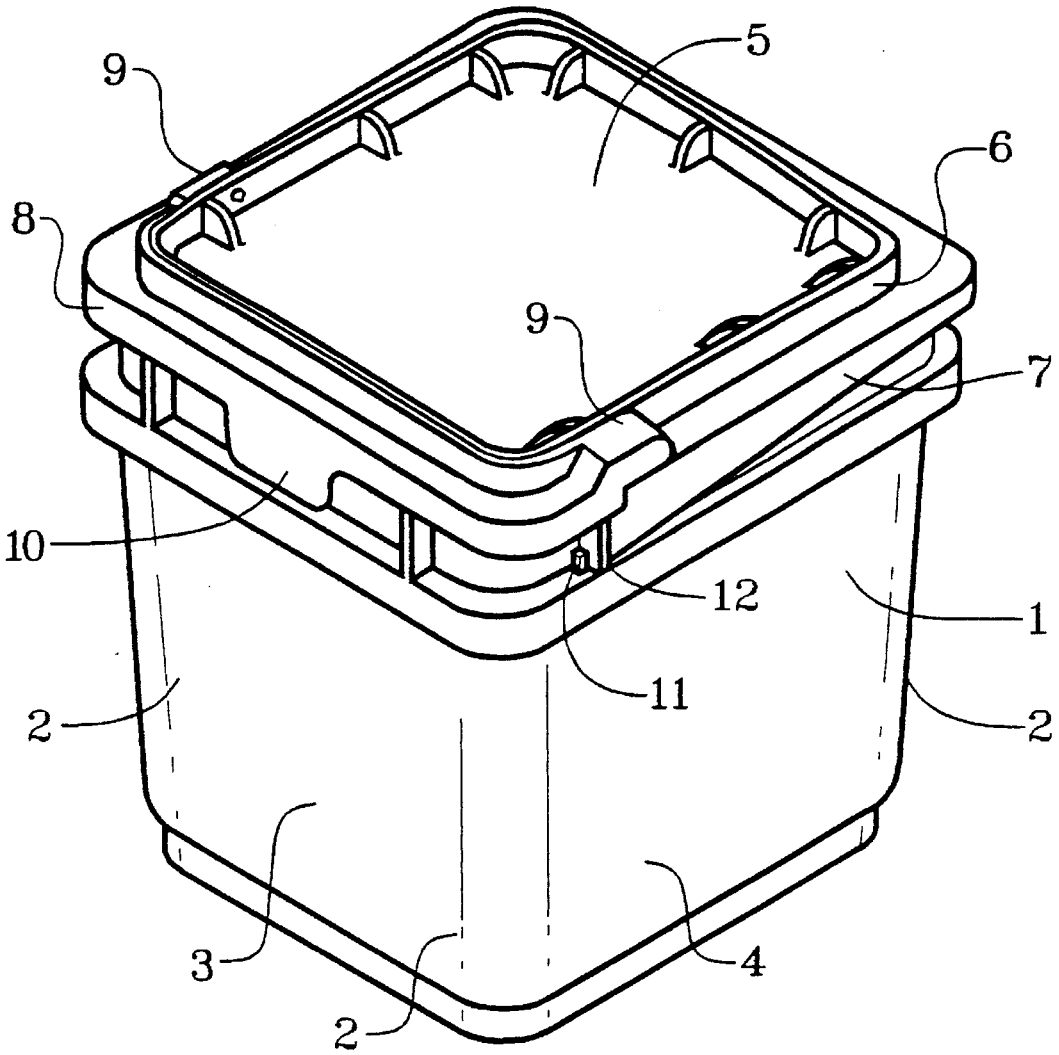
FIG. 1 is a perspective view of a preferred form of my container, showing the closure in place.

In FIG. 1, it will be seen that the preferred container has a generally square or somewhat rectangular shape. Such a shape is no more difficult to make by injection molding than is a cylindrical one. As is well known, when cylindrical containers are packed in rows in rectangular configured larger containers for transport or storage, they will contain far less material than would be possible if the containers were square or rectangular; in purely geometric terms, the area of a circle having a diameter of 1 is about 79% of the area of a square having a side of 1, in which the circle will fit snugly—thus about 21% more volume of material can (ideally) be shipped in a square container. Put another way, the increase in volume which the square container affords relative to the cylindrical one (without taking into account possible savings in space by nesting contiguous rows of cylinders) is about 26%. Of course, the manufacturer may elect to make the side of the square container smaller than the diameter of the cylindrical one—that is, he may elect to place the same volume of material in a square container rather than increase its size.

In FIG. 1, container body I is generally rectangular and in this case is generally square, although it may be rounded at corners 2. It has a front 3 and sides 4 which are differentiated in this view mainly by the construction of closure 5. On the side 6 of closure 5 may be seen, rather prominently, the cantilever guide 7. Prominently on the front of closure 5 is lock bar 8. Lock bar 8 extends across the entire front of closure 5, and has two important features—hinges 9 and handle 10. In order to remove the closure 5 and open the container, one must grasp handle 10 and pull it outwardly to disengage it from the top chime 16 (see FIG. 2) of the container body 1. The lock bar 8 then swings upwardly on hinges 9 and may be used to draw the closure 5 away from the front 3, in a backwards direction as guided by the cantilever guides 7.

The lock bar 8 is preferably hinged more or less as shown at an off-center position to discourage its use as a handle.

It should be noted that nub 11, which forms the end of cantilever guide 7, projects through a hole in rib 12 of container body 1.

Figure 2:
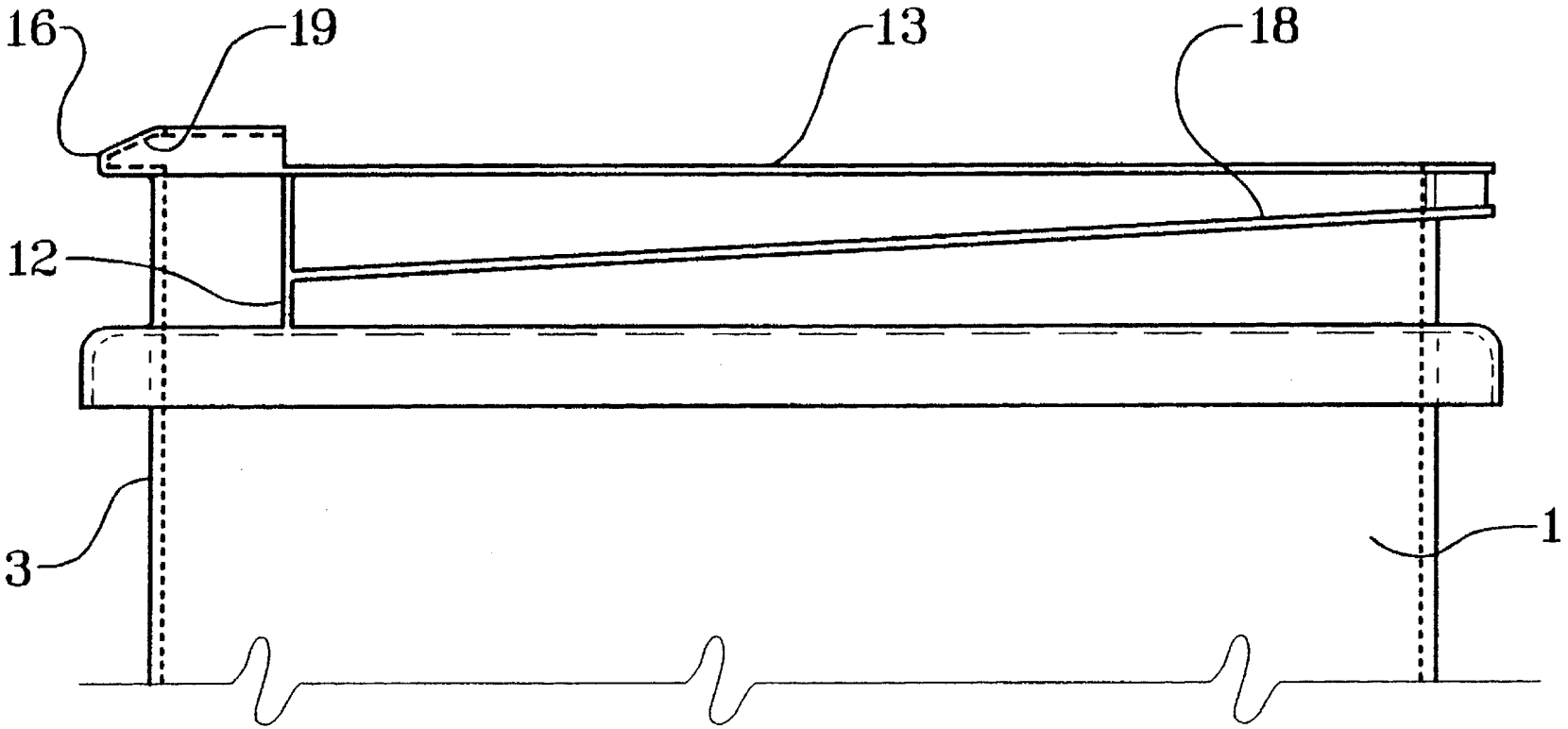
FIG. 2 is a side view of the container body.

Referring now to FIG. 2, the substantially horizontal sealing surface 13 is seen to comprise the top rim or surface of container body 1. Also shown in FIG. 2 is guide surface 18, which will be seen to co-act with cantilever guide 7 on closure 5 (see FIG. 3).

Figure 3:
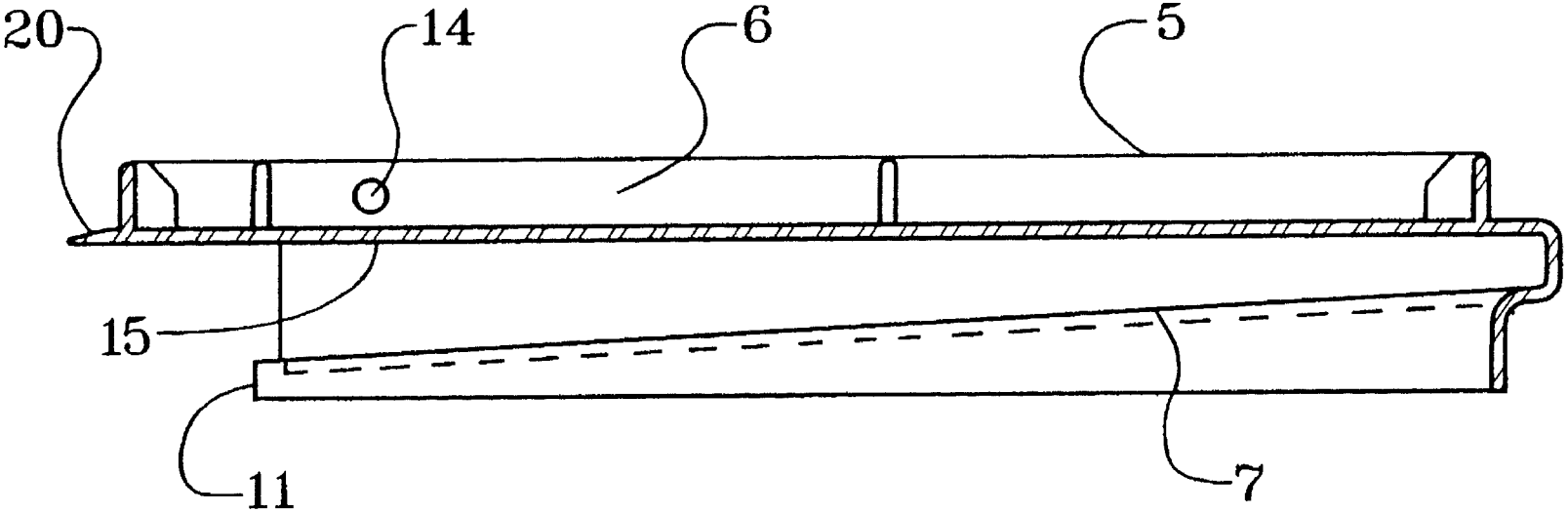
FIG. 3 is a side view of the closure, with the lock bar removed.
Figure 4:
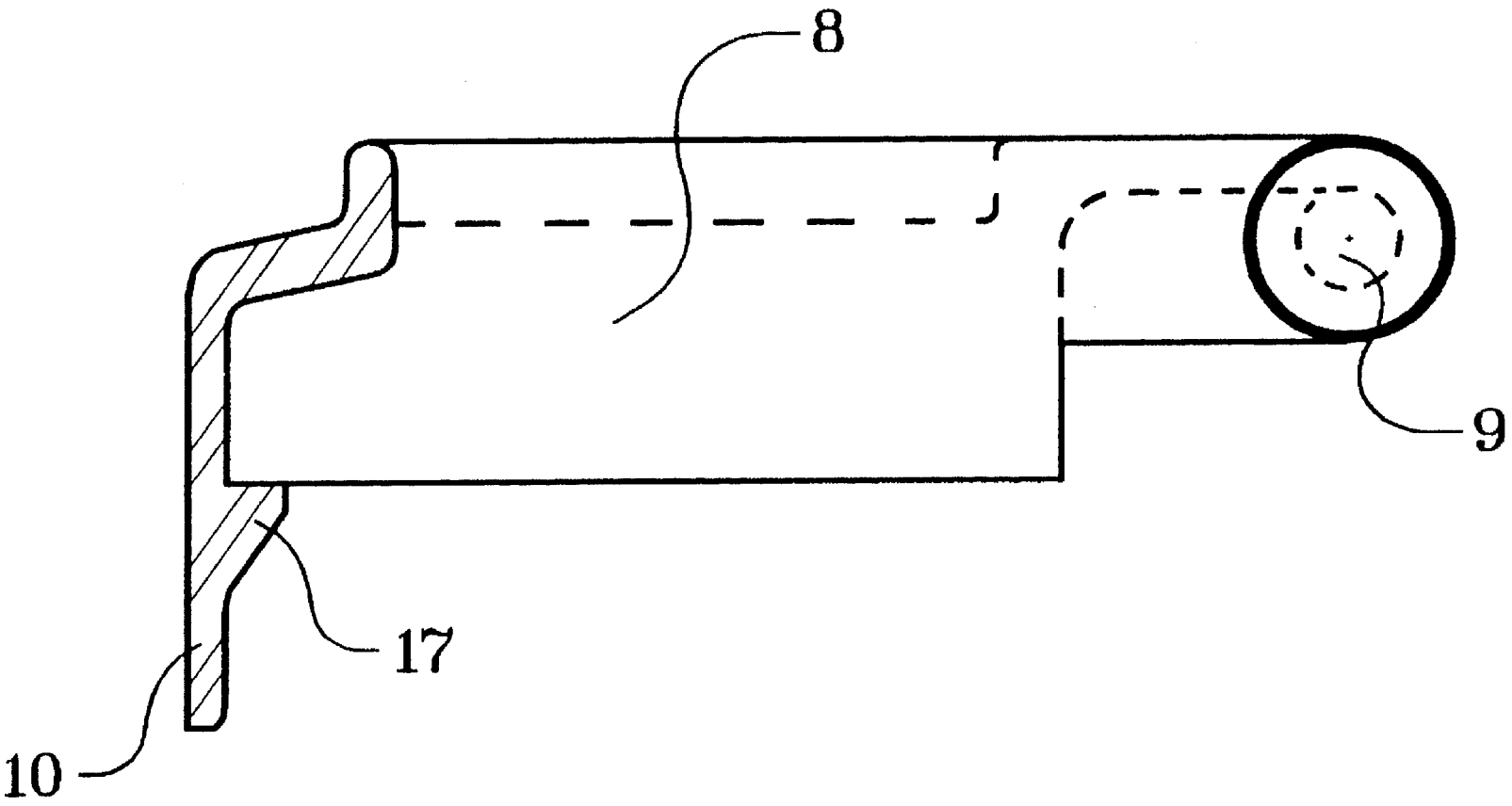
FIG. 4 is an enlarged side view of the lock bar.

In FIG. 3, closure 5 is seen without lock bar 8, revealing socket or hole 14 for pivot 9, shown in FIGS. 4, 5*a*, and 5*b*. Prominently featured is cantilevered guide 7 having approximately the same inclination as guide surface 18 shown in FIG. 2. Substantially horizontal under surface 15 will form a tight seal with container 1's substantially horizontal sealing surface 13.

FIG. 4 shows the detail of a preferred lock bar 8, having pivot 9 and handle 10. Behind handle 10 is a ridge 17 which snaps under front chime 16 (see FIG. 2). The thermoplastic handle 10 is flexible enough to permit an adult to unsnap the engagement with the chime 16, but stiff enough to present difficulty to a child.

As illustrated in FIGS. 5*a* and 5*b*, the cantilever guide 7, acting together with the complementary guide surface 18 on the container body 1 not only assures that the closure will move in the correct direction, but also forces the closure downward into a position where the under surface 15 of closure 5 contacts the container's substantially horizontal sealing surface 13 on container body 1 and overtakes it to form a primary seal as shown in FIG. 5*b*. The aforementioned guide surface 18 thus supplies the downward acting force to seal the two sides and back of surface 13. Working together with guide surface 18 is cantilever guide 7 to supply the tight seal between surface 15 of the closure and substantially horizontal sealing surface 13 of the container. Also working together with the aforementioned are surface 19 of the container front and surface 20 of the closure front that overlap each other to form a secondary seal on the remainder of the top chime 4 of the container. The sealing surfaces on said container front and said closure front such that the sealing surface 20 on said closure front engages beneath the sealing surface 19 on the container front, when said closure is in a position covering said open top. The cantilever guide surface 7 in contact with guide 18 also directs nub 11 to engage a hole in rib 12 on the container body 1 to create an additional fastening device whose function is to prevent outward movement of the cantilever guide 7.

FIGS. 5*a* and 5*b* are meant to illustrate the placement of the closure 5 on the container body 1. FIG. 5*a* first shows the alignment of the closure as it has moved about two thirds of the way from the back to the front of container body 1. Its movement is guided by guide 18 on the container body 1 and guide 7 on closure 5. Cantilever guide 7 is seen to overlap guide 18 to assure it stays on the correct path. Lock bar 8 is shown in a raised position, rotated on hinge 9. When closure 5 is in the secured position on the container body 1 as illustrated in FIG. 5*b*, nub 11 has protruded through rib 12. Lock bar 8 is then rotated downward on hinge 9 and ridge 17 is snapped into place under chime 16.

It will be clear to persons skilled in the art, from the above description, that the container body need not be square, but that the two sides should be substantially parallel. While certain slightly converging or diverging sides could be operable, and I would consider them to be substantially parallel, such converging or diverging (depending on how one looks at them) should of course permit the closure to be guided into place substantially as illustrated, but it is believed that such convergence or divergence would weaken the sealing effects particularly of the container chime and closure edge on impact from certain directions. But a more or less rectangular shape as opposed to a more or less square shape is quite within my invention, since the two sides having the cantilevered guiding surfaces will be parallel in any event and the advantages of efficient volume will also be realized.

My multiple seal approach ensures against unusual distortions on impact and leaks which might be caused by great strain on the structure.

I claim:

1. A thermoplastic container and closure comprising (a) a container body having two substantially parallel container sides, a container front, a container back, and an open top defined by a chime, (b) a closure of a shape generally similar to said open top, including a closure front, a closure back, and two parallel closure sides, said closure back and closure sides having skirts adapted to overlap said chime, and complementary substantially horizontal sealing surfaces, (c) substantially horizontal sealing surfaces on said parallel container sides and container back adapted to mate with and form a tight seal with said complementary substantially horizontal sealing surfaces on said parallel closure sides and closure back when said closure is in a position covering said open top, (d) complementary tapered guide surfaces on said container sides and said closure sides for guiding said closure frontwardly from the back of said container, said tapered guide surfaces adapted to force said closure downwardly to effect said tight seal between said substantially horizontal sealing surfaces on said parallel sides and container back, (e) sealing surfaces on said container front and said closure front such that the sealing surface on said closure front engages beneath the sealing surface on the container front, when said closure is in a position covering said open top, (f) a projecting nub at the front end of said guide surfaces of said closure sides, adapted to be lockably inserted into an aperture in said container body, when said closure is guided into place to cover said open top, and (g) a hinged lock bar on said closure adapted to fixedly and sealably engage a lock bar receiving chime on said front of said container body when said closure is in a position covering said open top.

2. The container and closure of claim 1 wherein said lock bar is hinged at an off-center point.

3. The container and closure of claim 1 shaped substantially as a square.

* * * * *